United States Patent [19]

Olson

[11] 4,241,393

[45] Dec. 23, 1980

[54] AUXILIARY REFLECTOR

[76] Inventor: Goodwin W. Olson, 1066 El Dorado Dr., Fullerton, Calif. 92635

[21] Appl. No.: 48,502

[22] Filed: Jun. 14, 1979

[51] Int. Cl.[3] ..... F21V 7/20

[52] U.S. Cl. ..... 362/348

[58] Field of Search ..... 362/348, 347, 341, 296, 362/297, 350, 345; 350/293, 296, 288

[56] References Cited

U.S. PATENT DOCUMENTS

| | | | |
|---|---|---|---|
| 1,637,429 | 8/1927 | Stewart | 362/348 |
| 1,841,917 | 1/1932 | Schimpff | 362/348 |
| 2,132,850 | 10/1938 | Huflage | 362/348 |

FOREIGN PATENT DOCUMENTS

| | | | |
|---|---|---|---|
| 2602303 | 7/1976 | Fed. Rep. of Germany | 362/341 |
| 369338 | 1/1907 | France | 362/297 |
| 1011778 | 1/1965 | United Kingdom | 362/341 |

*Primary Examiner*—Jon W. Henry

*Attorney, Agent, or Firm*—George W. Finch

[57] ABSTRACT

A light intensifier for increasing the useful light output of relatively inefficient light fixtures by providing a diffusing light reflector which extends about the light therein. The reflector can be ribbed so that it can be adjusted to fit within the existing inefficient fixture and can be constructed from foil, metalized mylar or other similar materials with a heat tolerant, electrically insulating backing. Insulated perforations may be included so that the reflector can be adjusted in size without danger of inducing an electrical short circuit.

6 Claims, 8 Drawing Figures

AUXILIARY REFLECTOR

BACKGROUND OF THE PRESENT INVENTION

Many lamp fixtures now in use were designed with appearance of the fixture in mind rather than the efficient transmission of light from its source to the area to be illuminated. Since these fixtures represent a large capital investment throughout the population, it is desirable to replace them with more efficient fixtures now that the cost of powering the light source, such as an electric light bulb, has increased, and it is generally believed that it is desirable for the population as a whole to conserve electrical energy. Unfortunately, such replacement is costly and has a long cost recovery period which homeowners are not likely to perceive as economic.

Some of the fixtures in use in various locations actually absorb light energy rather than diffusing it properly and therefore are relatively inefficient. Means are needed to convert such fixtures or their lampshades into ones which projet light in a more efficient manner so that either a smaller wattage light bulb can be used to produce the same illumination of the desired area or less illuminators in the forms of lamps need to be turned on to create the needed light level.

SUMMARY OF THE PRESENT INVENTION

Generally, the present invention is comprised of a layer of light reflective metal of maximum reflective capability having acceptable strength and minimal thickness to withstand the forming processes of manufacture. Of the available foils or sheets of useable thicknesses, aluminum is preferred because of its low cost and availability. However, other materials which can be processed to have a reflective surface can be utilized and in preferred embodiment, the reflective layer is sandwiched between layers of heat resistant plastic, the reflecting surface thereof being covered by a plastic layer which is transparent. By suitably folding and molding such material, an adjustable generally conical or parabolic light reflector can be constructed having a small hole in its center through which the base of a light bulb can be extended the outwardly extending sides of the reflector preferably extend to the original reflector or diffuser of the light fixture. The reflector can include concentric circles of perforations adjacent the center hole and the outer edge so that the center hole can be increased in diameter to accommodate light bulbs having various diameter bases and so that the reflector can be reduced in size so that it does not extend beyond the fixture more than is desired. It is also preferable that at least the perforations adjacent the center hole be in areas that are unmetalized or where the foil has been removed so that the plastic layers act as electrical insulators. This isolates any electrical potential on the base of the light bulb so it cannot be transferred to the reflector and hence to the fixture where it can short and cause damage. A plurality of heat resistant strips of adhesive material attached to the back of the reflector can be included for semi-permanent fixation of reflector to the light fixture.

Reflectors constructed according to the present invention can also be constructed in strips having embossed pyramidal-shaped elevations to give maximum diffusion and permit forming without reducing or fracturing the metal sheet to any degree. This type of reflective material is especially useful in reflecting light from lampshades that have low or no transparency and for fluorescent tube fixtures. Like the previously mentioned embodiment, heat resisted adhesive strips can be used along the back of such reflectors to mount them to the shade or reflector.

It is therefore an object of the present invention to provide means for increasing the light output of light fixtures by correcting light absorbing designs.

Another object is to provide means to convert an essentially omni-directional light fixture into one which the light from a light source is directed to a localized area.

Another object is to provide an auxiliary reflector for a light fixture which is relatively economical, easy to manufacture and does not present any shock hazard.

Another object is to provide an auxiliary reflector which easily can be adapted to fixtures of various sizes and shapes by the user and therefore can be provided in kit form.

Another object is to provide a bright auxiliary reflector whose configuration causes the total effective light reflecting surface thereof to be semi-Lambrusian in nature.

These and other objects and advantages will become apparent to those skilled in the art after considering the following detailed specification which covers preferred embodiments thereof in conjunction with the accompanying drawings.

DETAILED DESCRIPTION OF THE SHOWN EMBODIMENT

Figure 1:
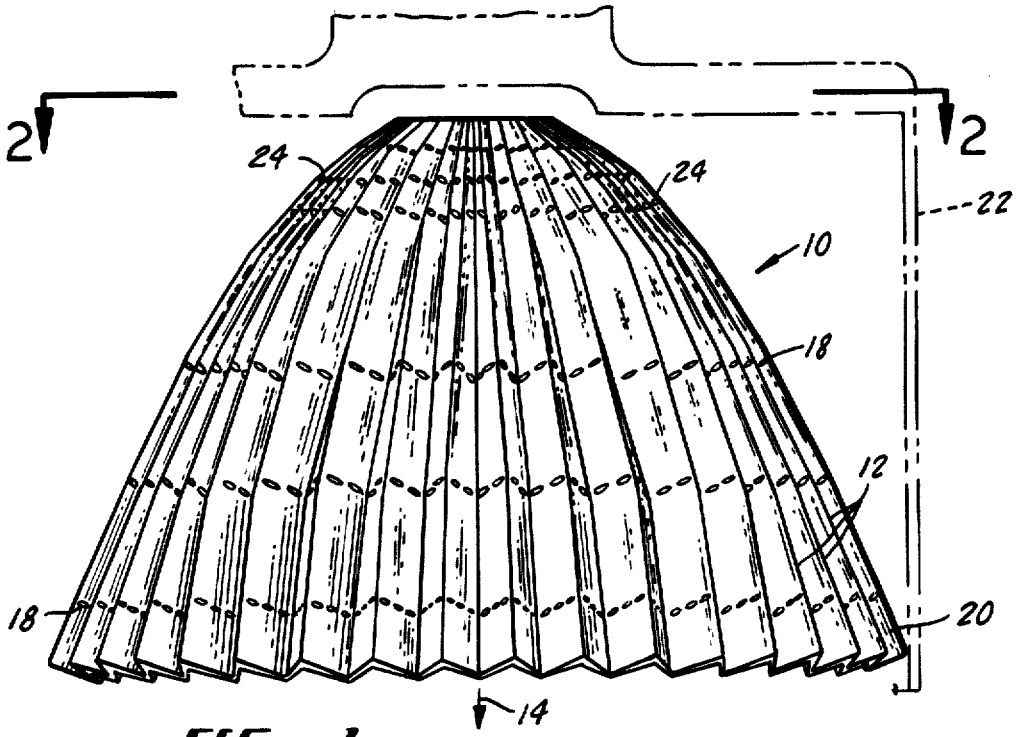
FIG. 1 is a side elevational view of a reflector constructed in accordance with the present invention in a fixture.
Figure 2:
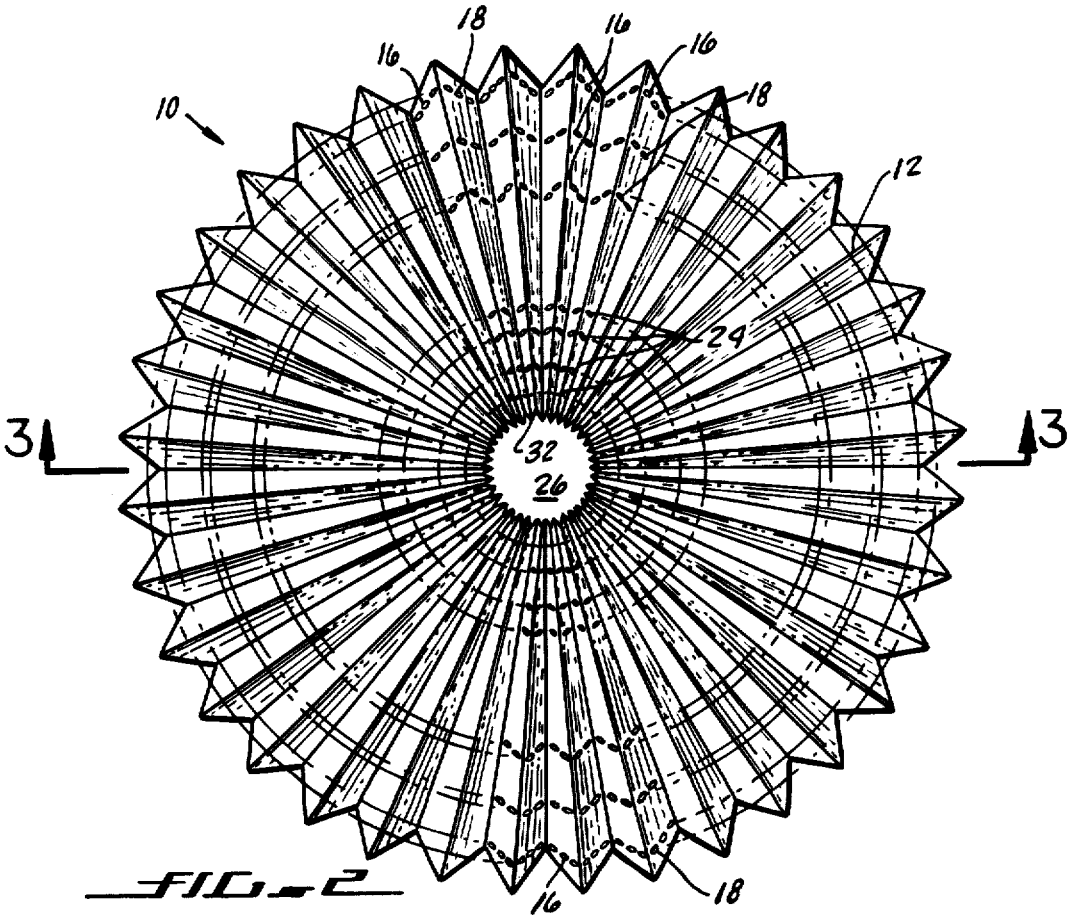
FIG. 2 is a top elevational view taken at line 2—2 in FIG. 1.
Figure 3:
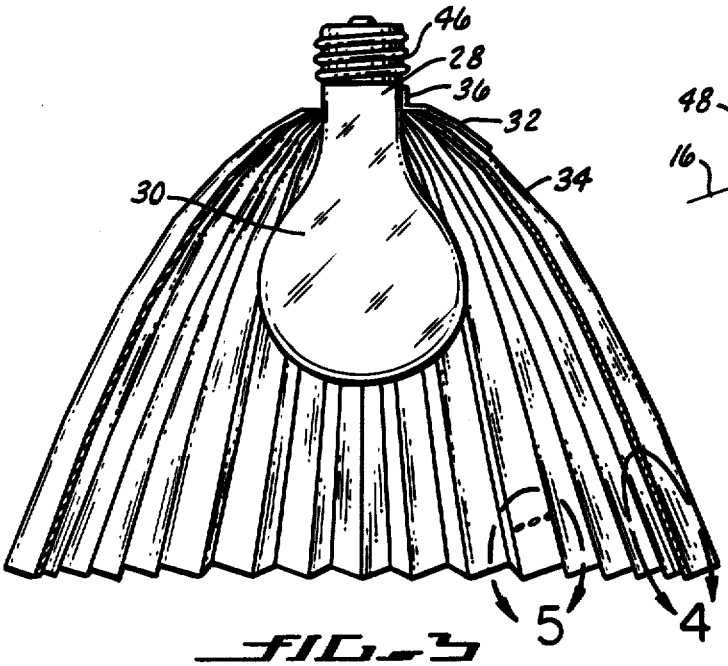
FIG. 3 is a cross-sectional side elevational view of the reflector of FIGS. 1 and 2 in position on a light bulb.

Referring to the drawings, more particularly by reference numbers, number 10 in FIG. 1 refers to an auxiliary reflector constructed according to the present invention. The reflector 10 preferably is constructed from a disc of reflective material having pleats 12 so the reflector 10 can be formed into the generally parabolic reflector shape shown. The pleats, in addition to allowing proper formation of the reflector 10, act as diffusers so that although the parabolic reflector 10 concentrates light in a pre-determined direction 14, such light is not focused sharply. As shown in FIGS. 1 and 2, the reflector 10 includes a plurality of concentric circles 16 of perforations 18 which provide means for shortening the reflector 10 such as by tearing off the strip 20. The perforations 18 also allow the pleats 12 to be bent so that a parabolic rather than conic shape can be formed either during the original manufacture of the reflector 10 or when it is being fitted to a particular light fixture 22, shown in dashed outline. Inner concentric circular strips 24 also can be provided so that the center opening 26 of the reflector 10 through which the neck 28 of a light bulb 30 (FIG. 3) is extended, can be adjusted for necks 28 of various diameters by merely removing an inner strip 24. The reflector 10 can be held in position by suitable heat resistive adhesive tape 32 which can be fixed to the outer surface 34 of the reflector 10 and extended to adhesively attach at one end 36 to the bulb 30. This method of reflector attachment allows removal of the reflector 10 when the bulb 30 needs replacement.

Figure 5:
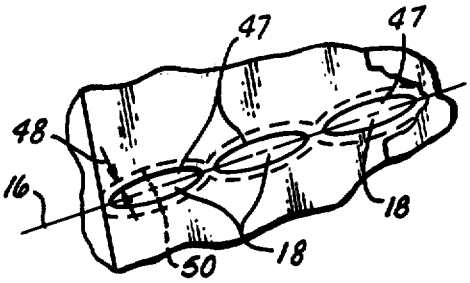
FIG. 5 is an enlarged view of the area encircled at 5 in FIG. 3.
Figure 4:
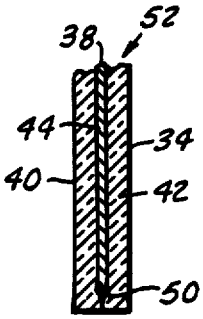
FIG. 4 is an enlarged cross-sectional view taken at line 4—4 in FIG. 3.

The reflector 10 is preferably constructed including a layer of reflective metal whether it be metal foil, sheet or a metalized layer, such as is commonly applied to metalized mylar. The metal layer 38 may it be of any suitable material, such as aluminum, silver, tin or the like which can be processed with a reflective surface. As is shown in FIG. 4, the reflective layer 38 is encased between inner and outer layers 40 and 42 of electrically insulative material such as plastic with at least the inner layer 40 being transparent so that light can be reflected from the front surface 44 of the reflective layer 38. This encasement is preferable when the reflector 10 is to be used in locations where it might come in contact with electrical energy, such as can be present on the base 46 of the light bulb 30. As shown in FIG. 5, the perforations 18, especially those forming the perforation circles 16 which are useful in adjusting the size of the center opening 26 are oval in shape with their major axes 47 in general alignment in the circle. The adjacent portions of the reflective layer 38, which is normally conductive is interupted a pre-determined distance 48 from the perforations 18 so that upon tearing the reflector 10 along the perforated circle 16, the edge 50 of the reflective material is not exposed but instead is insulated by the plastic layers 40 and 42. This arrangement can be seen by reference to FIG. 4 wherein the lower edge 50 of the reflective layer 38 terminates while the inner and outer layers 40 and 42 continue so that the edge 50 is not exposed. This provides a double insulating system so that should by some circumstance the reflective layer become electrically charged it cannot complete a circuit to cause a short. For this reason the layers 40 and 42 must have a predetermined thickness 52 to provide the desired electrical insulating qualities.

Since the layer 42 is not required to be transparent it can be constructed from materials other than transparent plastic such as heat resisting composition, fabric or mineral fibers.

Figure 6:
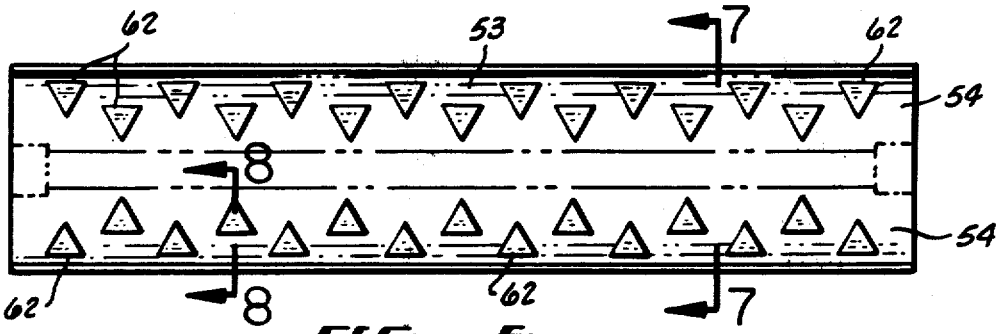
FIG. 6 is a side elevational view of a modified embodiment of the reflector in strip form installed on a fluorescent fixture.
Figure 7:
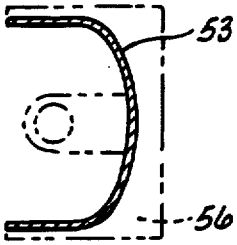
FIG. 7 is a cross-sectional view taken at line 7—7 in FIG. 6.
Figure 8:
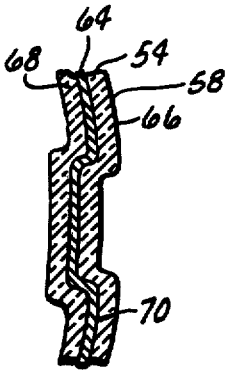
FIG. 8 is an enlarged cross-sectional view taken at line 8—8 in FIG. 6, showing the construction details of the reflector.

Referring to FIGS. 6, 7 and 8, an alternate embodiment 53 is shown which includes a strip 54 of reflective material. The strip 54 can be applied to a linear fixture 56 such as those used for fluorescent tubes. Such strips 54 can be provided with an adhesive backing 58 so that they can be stuck to the reflector 60 of the fixture 56 whose characteristics are to be improved. The strips 54 preferably are embossed with a plurality of pyramidal reflectors 62 which are highly efficient in reflecting and diffusing light.

As shown in FIG. 8, the strips 54 are constructed with a central reflective layer 64 which is backed by a suitable heat resistant layer 66. Since such strips do not present a shock hazard when properly used, a transparent electrically insulative front layer 68 is only optionally provided since all transparent layers reduce the reflectance of the surface 70 of the reflecting layer 64 at least in some measure.

Thus there has been shown as described novel auxiliary reflectors to improve the efficiency of inefficient light fixtures which fulfill all the objects and advantages sought therefore. Many changes, alterations, modifications and other uses and applications of the subject auxiliary reflector will become apparent to those skilled in the art after considering this specification together with the accompanying drawings. All such changes, alterations and modifications which do not depart from the spirit and scope of the invention are deemed to be covered by the invention which is limited only by the claims which follow:

What is claimed is:

1. An auxiliary reflector for correcting the design deficiencies of pre-existing light fixtures having a light source by intensifying the light generated thereby including a reflector member having:

an outer edge thereabout;

an inner edge which defines an opening therethrough through which the light source can extend;

a layer of reflective material that extends substantially from said inner edge to said outer edge, said layer of reflective material having front and back sides;

a first layer of electrically insulative material which is transparent to light covering said front side of said reflective layer;

a second layer of electrically insulative material covering said back side of said reflective layer, said first and second layers of electrically insulative material extending from said inner edge to said outer edge of said member;

a plurality of perforations formed in at least one circle about said inner edge whereby said reflector member can be modified to have an inner edge of larger diameter by tearing said reflector member along said circle of perforations; and a plurality of perforations formed in at least one circle adjacent said outer edge whereby said reflector member can be modified to have an outer edge of smaller diameter by tearing said reflector member along said circle of perforations adjacent said outer edge, said perforations extending through said first and second layers of electrically insulative material, said layer of reflective material being electrically conducting and having generally circular cutouts along said circles of perforations whereby tearing of said reflector member along a circle of perforations does not expose said layer of reflective material to electrical contact.

2. The auxiliary reflector as defined in claim 1 wherein said reflector member includes a plurality of pleats which extend from said inner edge to said outer edge thereof, said reflector member being generally conically shaped with said first layer on the interior of the cone so formed.

3. The auxiliary reflector as defined in claim 1 wherein said layer of reflective material has an outer edge and an inner edge, said first and second layers of electrically insulative material having outer and inner edges which extend beyond said outer and inner edges of said layer of reflective material so that said layer of reflective material is not exposed to electrical contact at said outer and inner edges thereof.

4. An auxiliary reflector for correcting the design deficiencies of pre-existing light fixtures having a light source by intensifying the light generated thereby including a reflector member having:

an outer edge thereabout;

an inner edge which defines an opening therethrough through which the light source can extend;

a layer of reflective material that extends substantially from said inner edge to said outer edge, said layer of reflective material having front and back sides;

a first layer of electrically insulative material which is transparent to light covering said front side of said reflective layer;

a second layer of electrically insulative material covering said back side of said reflective layer, said first and second layers of electrically insulative material extending from said inner edge to said outer edge of said member;

a plurality of perforations formed in at least one circle about said inner edge whereby said reflector member can be modified to have an inner edge of larger diameter by tearing said reflector member along said circle of perforations; and a plurality of pleats which extend from said inner edge to said outer edge of said reflector member, whereby said reflector member can be shaped into a generally parabolic shape with said first layer on the interior of the concave shape so formed, said plurality of perforations extending through said first and second layers of electrically insulative material, said layer of reflective material being electrically conducting and having generally circular cutouts along said circles of perforations whereby said layer of reflective material is not exposed to electrical contact.

5. The auxiliary reflector as defined in claim 4 wherein said reflector member includes an adhesive attachment adjacent said inner edge for connection to the fixture.

6. The auxiliary reflector as defined in claim 5 wherein said perforations are oval in shape having major axes in circular alignment and wherein said circles of perforations are concentric to each other.

* * * * *